US011021930B2

(12) United States Patent
Budde et al.

(10) Patent No.: US 11,021,930 B2
(45) Date of Patent: Jun. 1, 2021

(54) DIVERTER TOOL AND ASSOCIATED METHODS

(71) Applicant: Weatherford Technology Holdings, LLC, Houston, TX (US)

(72) Inventors: Marcel Budde, Vlaardingen (NL); Mark Baas, Vlaardingen (NL); George E. Givens, Spring, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 16/253,773

(22) Filed: Jan. 22, 2019

(65) Prior Publication Data

US 2020/0232302 A1 Jul. 23, 2020

(51) Int. Cl.
*E21B 34/08* (2006.01)
*E21B 21/10* (2006.01)

(52) U.S. Cl.
CPC ..... *E21B 34/08* (2013.01); *E21B 21/103* (2013.01); *E21B 2200/04* (2020.05); *E21B 2200/06* (2020.05)

(58) Field of Classification Search
CPC .... E21B 34/08; E21B 21/103; E21B 2200/06; E21B 2200/04
See application file for complete search history.

(56) References Cited

U.S. PATENT DOCUMENTS 5,960,881 A 10/1999 Allamon et al.
6,253,861 B1 7/2001 Carmichael et al.
6,390,200 B1 5/2002 Allamon et al.
6,491,103 B2 12/2002 Allamon et al.
6,513,590 B2 2/2003 Allamon et al.
6,834,726 B2 12/2004 Giroux et al.
6,920,930 B2 7/2005 Allamon et al.
7,063,156 B2 6/2006 Patel et al.
7,299,880 B2 11/2007 Logiudice et al.
7,318,478 B2 1/2008 Royer
7,322,432 B2 1/2008 Rogers et al.
(Continued)

OTHER PUBLICATIONS

Weatherford, Surge Master II Tool Runs Liners Faster and Safer Than Conventional Systems and Avoids Mud Losses , 2015, 1 page.
(Continued)

*Primary Examiner* — Giovanna Wright
*Assistant Examiner* — Yanick A Akaragwe
(74) *Attorney, Agent, or Firm* — Blank Rome LLP

(57) ABSTRACT

A diverter tool reduces surge pressure when running casing into a wellbore. The tool is kept open while running the casing so surge pressure can pass out a bypass port. The tool is then closed with a ball that lands in a seat disposed in an interposed condition in a sleeve of the tool's housing. Fluid pressure applied against the seat in the interposed condition engaged with the ball overcomes a first fixture temporarily holding the sleeve open. The fluid pressure shifts the freed sleeve closed. Additional fluid pressure applied against the seat with the captured ball then overcomes a second fixture temporarily holding the seat in the sleeve. Once freed, the seat with the captured ball pivots from the interposed condition to a stowed condition to expose the internal bore of the sleeve to the longitudinal bore of the tool so additional cementing operations can be performed.

27 Claims, 9 Drawing Sheets

(56) References Cited

U.S. PATENT DOCUMENTS

| | | | | |
|---|---|---|---|---|
| 7,694,732 | B2 | 4/2010 | Rogers et al. | |
| 9,518,444 | B2 | 12/2016 | Thompson | |
| 2004/0108109 | A1* | 6/2004 | Allamon ..... | E21B 23/04 166/243 |
| 2017/0089174 | A1* | 3/2017 | Budde ..... | E21B 34/10 |

OTHER PUBLICATIONS

Weatherford, Surge Master II Tool, Auto-Fill Float Collar Run Linter to TD Safer, Quicker, Avoid Mud Losses, Save Rig Time, 2012, 1 page.

Search and Examination Report in counterpart British Appl. GB2000302 dated Sep. 2, 2020, 12-pgs.

* cited by examiner

DIVERTER TOOL AND ASSOCIATED METHODS

BACKGROUND OF THE DISCLOSURE

To produce hydrocarbons from a formation, a wellbore is drilled from the surface of the earth using a drillstring. After the drillstring has drilled the wellbore to a first depth, the drillstring is removed from the wellbore. Operators then run a first section or string of casing into the drilled wellbore and set the first casing in place by flowing cement into the annulus between the outer diameter of the first casing and the wall of the wellbore.

Once the cement is allowed to cure, operators drill a further portion of wellbore extending to a second depth below the first portion. The drillstring is removed, and a second casing string or casing section is run into the wellbore through the first casing and into the further portion of the wellbore. The second casing is sometimes termed a "liner" when it is placed below casing already within the wellbore.

The second casing has a smaller outer diameter than the inner diameter of the first casing so the second casing can be run through the first casing. Once an upper portion of the second casing reaches a lower portion of the first casing, the second casing is temporarily hung off of the first casing, usually by a liner hanger. Cement is then flowed into the annulus between the outer diameter of the second casing and the wellbore and allowed to cure to set the second casing within the wellbore. This process can be repeated as many time as needed to place casing sections within the wellbore to form a cased wellbore of a desired depth.

Once the casing sections of increasing depth are placed within the wellbore, it is often necessary or desirable to run wellbore tools into the casing. Furthermore, after setting the casing within the wellbore at the desired depth for hydrocarbon production, the hydrocarbon fluid migrates through the inner diameter of the casing to the surface of the wellbore. For this reason, it is desirable that the cased wellbore possess the largest inner diameter possible for its depth to allow for the maximum area for fluid flow during hydrocarbon production as well as to permit maximum clearance for wellbore tools through the cased wellbore. Therefore, each subsequently-run casing usually has only a slightly smaller outer diameter than the inner diameter of the previously-run casing to allow for maximum effective inner diameter over the depth of the casing within the wellbore.

Because of the small variance between the outer diameter of the subsequently-run casing section and the inner diameter of the previously-run casing section, little annular clearance between the casing sections may exist during run-in. The small annular clearance causes a large amount of surge pressure to be imparted on the formation below the previously-run casing when the subsequently-run casing section is lowered into the wellbore. Over-pressurizing the formation can cause damage to the formation, jeopardizing production of hydrocarbons.

Additionally, when running casing into the wellbore, fluid located within the wellbore tends to flow up through the inner diameter of the casing being run into the wellbore. In particular, because of the pressure exerted on the formation when running in a casing sections when little annular clearance exists, downhole fluid may flow up through the casing section to relieve the pressure within the wellbore. The velocity of this upward flow can be problematic and is exacerbated by the presence of the running string used to run each casing section into the wellbore. The running string typically has a reduced inner diameter compared to the inner diameter of the casing previously disposed within the wellbore, which causes an increase in pressure within the running string as the fluid flows upward through the running string.

Due to the increase in pressure experienced by the fluid flowing upward within the running string, the fluid velocity tends to increase when it flows from the less restricted inner diameter of the disposed casing to the reduced diameter of the running string. An uncontrolled flow of fluid from downhole causes fluid to flow onto the rig floor from downhole.

To partially alleviate the surge problem, casing sections are often run into the wellbore at reduced speeds to decrease pressure on the fluid within the wellbore caused by running in the casing. Reducing the running speed of the casings into the wellbore and cleaning up the rig floor increases the amount of time required to obtain a producing wellbore, thereby increasing the cost of the wellbore.

A similar problem occurs when running casing into a wellbore formed in a delicate formation, regardless of whether a previous casing exists and regardless of whether the clearance between casings is small. Running casing into a delicate formation could easily result in damage to the formation due to high downhole pressure caused by running the casing into the wellbore.

To prevent the problems that occur due to small clearances in the annulus between casing section and due to pressure on delicate formations, diverter tools have been developed to divert fluid into the wellbore annulus while running the casing into the wellbore. The diverter tool is typically a tubular body disposed within the running string and is attached above the running tool connected to the casing. The diverter tool is open during run-in and can be closed when it has reached casing depth.

Some typical diverter tools have a ball seat for engaging a ball so the tool can be closed. In order for additional tools, cement plugs, darts, and the like to pass through the tool for further operations downhole, the ball is extruded through the ball seat. Although this works, there are a number of disadvantages. The increased pressure to extrude the ball through the seat can cause the ball to cannon downhole, potentially damaging downhole components. The ball also remains downhole and could hinder further operations. Finally, the extruded seat left after passage of the ball can still provide a narrow diameter for the passage of the additional devices, cement plugs, darts, and the like used in further operations downhole. In fact, the extruded seat may damage the sealing capability of some of these devices once they pass.

The subject matter of the present disclosure is directed to overcoming, or at least reducing the effects of, one or more of the problems set forth above.

SUMMARY OF THE DISCLOSURE

According to the present disclosure, a diverter tool is used for reducing surge pressure when running casing into a wellbore. The tool is operable with a plug, such as ball, and comprises a housing, a sleeve, and a seat. The housing has a longitudinal bore therethrough and defines a bypass port communicating the longitudinal bore outside of the housing. The sleeve is movably disposed in the longitudinal bore and has an internal bore therethrough. The sleeve is movable in the longitudinal bore from an opened position (open relative to the bypass port) to a closed position (closed relative to the bypass port).

The seat is disposed in the internal bore of the sleeve and defines a seat opening permitting fluid communication therethrough. The seat is rotatable in the internal bore from an interposed condition to a stowed condition. The seat in the interposed condition is interposed in the internal bore and is configured to engage the plug in the seat opening. The seat in the interposed condition engaged with the plug moves the sleeve from the opened position to the closed position in response to applied fluid pressure in the longitudinal bore. The seat in the sleeve in the closed position rotates from the interposed condition to the stowed position and exposes the internal bore of the sleeve to the longitudinal bore of the housing.

The tool can comprise a lock disposed between the sleeve and the housing and locking the sleeve in the closed position. For example, the lock can comprise a snap ring disposed about the sleeve and engaging in a circumferential shoulder defined in the longitudinal bore.

The seat can comprise an arm connected to the seat and having a pivot point disposed in a slot. The pivot point can be moveable in the slot, permitting the arm to rotate the seat from the interposed condition to the stowed position.

The sleeve can define a side pocket of the internal bore in which the seat rotates in the stowed condition.

In a configuration, the tool can comprise a temporary fixture disposed between the sleeve and the housing and temporarily holding the sleeve in the opened position up to a first limit of the applied fluid pressure. The temporary fixture releases the sleeve to move from the opened position to the closed position in response to the first limit of the applied fluid pressure acting thereagainst.

In one example, the temporary fixture can comprise a biasing element biasing the sleeve to the opened position and acting against a level below the first limit of the applied fluid pressure tending to prematurely close the sleeve.

In another example, the temporary fixture can comprise one or more radial pins disposed in the longitudinal bore of the housing and shearably engaging the sleeve. The sleeve can define one or more transverse slots each having one of the one or more radial pins retained therein. Each of the one or more transverse slots can comprise a longitudinal slot extending therefrom in which the radial pin is movable along. The one or more transverse slots can comprise a retainer clip permitting passage of the radial pin in a first direction into the transverse slot from a proximal end the longitudinal slot and preventing passage of the radial pin in a second direction opposite the first direction.

In a configuration, the tool can comprise a temporary fixture disposed between the seat and the sleeve and holding the seat in the interposed condition up to a second limit of the applied fluid pressure. The temporary fixture releases the seat to move from the interposed condition to the stowed condition in response to the second limit of the applied fluid pressure limit acting thereagainst. In one example, the temporary fixture can comprise a shear ring disposed between the seat and a ledge in the internal bore.

In a configuration, the tool can comprise a lock locking the seat in the stowed position. In one example, the lock can comprise a biased first shoulder disposed in the internal bore of the sleeve and engaging against a second shoulder of the seat.

In a configuration, the tool can comprise first and second seals disposed on the sleeve. The first and second seals on the sleeve in the closed position can sealably engage in the longitudinal bore respectively upbore and downbore of the bypass port. The sleeve can comprise a cross port disposed upbore of the seat and disposed downbore of the second seal. The cross port can communicate the internal bore of the sleeve with an annulus between the sleeve and the longitudinal bore. Each of the first and second seals on the sleeve in the opened position can be sealably disengaged in the longitudinal bore and can be exposed on both sides by tubing pressure in the annulus. By contrast, each of the first and second seals on the sleeve in the closed position sealably engaging in the longitudinal bore can be exposed to a pressure differential between the tubing pressure in the annulus and a borehole pressure from the bypass port. A third seal can be disposed on the sleeve, the third seal on the sleeve when opened and closed can sealably engage in the longitudinal bore downbore of the cross port.

According to the present disclosure, a diverter tool is for reducing surge pressure when running casing into a wellbore. The tool is operable with a plug, such as a ball, and comprises a housing, a sleeve, a seat, a first temporary fixture, and a second temporary fixture.

The housing has a longitudinal bore therethrough. The housing defines a bypass port communicating the longitudinal bore outside of the housing. The sleeve is movably disposed in the longitudinal bore and has an internal bore therethrough. The sleeve is movable in the longitudinal bore from an opened position (open relative to the bypass port) to a closed position (closed relative to the bypass port).

The seat is disposed in the internal bore of the sleeve and defines a seat opening permitting fluid communication therethrough. The seat is rotatable in the internal bore from an interposed condition to a stowed condition. The seat in the interposed condition is interposed in the internal bore and is configured to engage the plug in the seat opening. The seat in the stowed condition exposes the internal bore of the sleeve to the longitudinal bore of the housing.

The first temporary fixture is disposed between the housing and the sleeve. The first temporary fixture holds the sleeve in the opened position up to a first limit of applied fluid pressure and releases the sleeve to move from the opened position to the closed position in response to the first limit acting against the seat in the interposed condition engaged with the plug. The second temporary fixture is disposed between the seat and the sleeve. The second temporary fixture holds the seat in the interposed position up to a second limit of the applied fluid pressure greater than the first limit and releases the seat to rotate from the interposed condition to the stowed position in response to the second limit acting against the seat in the interposed condition engaged with the plug.

According to the present disclosure, a method comprises: running casing into a wellbore with a running string having a diverter tool disposed thereon; diverting surge pressure passing uphole through the running string out of a bypass port in the diverter tool until the casing is run to depth by temporarily holding a sleeve opened relative to the bypass port inside the diverter tool; engaging a plug in a seat interposed in an interposed condition in an internal bore of the sleeve in the diverter tool; shifting the sleeve closed relative to the bypass port by applying a first limit of fluid pressure against the plug seated in the seat; and pivoting the seat with the engaged plug from the interposed condition to a stowed condition in the internal bore of the sleeve by applying a second limit of the fluid pressure against the plug seated in the seat.

The method can further comprise: launching the plug down the running string to the diverter tool to engage the plug in the seat; and/or pumping cement down the running string and through the diverter tool to cement the casing in the wellbore.

In shifting the sleeve closed, the method can comprise shearing the sleeve free to shift in the diverter tool with the first limit of the fluid pressure applied against the plug seated in the seat; sealing upbore and downbore of the bypass port respectively with first and second seals disposed on the sleeve and sealably engaged inside the diverter tool; and/or locking the sleeve closed.

In pivoting the seat with the engaged plug from the interposed condition to the stowed condition in the internal bore of the sleeve, the method can comprise: shearing the seat free to pivot in the sleeve with the second limit of the fluid pressure applied against the plug seated in the seat; and/or locking the seat in the stowed condition.

The method can further comprise, before running the casing, initially testing seals sealably engaged between the sleeve and the inside of the diverter tool by mechanically shifting the sleeve closed relative to the bypass port. The method can further comprise, after shifting the sleeve closed and before pivoting the seat, testing seals on the closed sleeve sealably engaged between the sleeve and the inside of the diverter tool.

The foregoing summary is not intended to summarize each potential embodiment or every aspect of the present disclosure.

DETAILED DESCRIPTION OF THE DISCLOSURE

Figure 1:
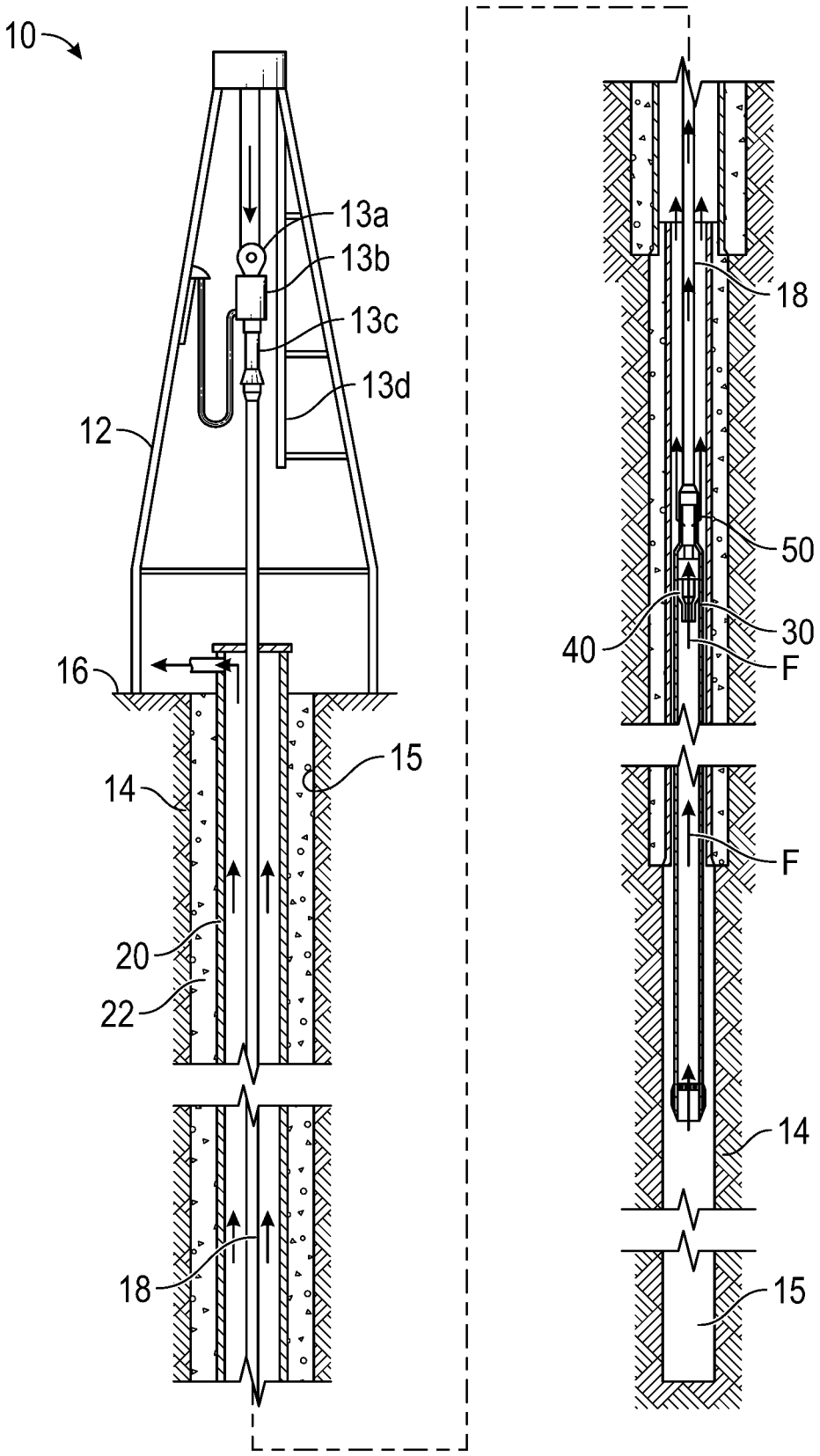
FIG. 1 illustrates a cross-sectional view of casing attached to a running string having a diverter tool for running the casing in a wellbore.

An assembly 10 in FIG. 1 includes a rig 12 suspending a traveling block 13*a*, which supports a top drive 13*b* movable vertically on a block dolly 13*d*. An influent drilling fluid line supplies the top drive 13*b* with drilling fluid from a drilling fluid reservoir (not shown). A launching manifold 13*c* connects to the running string 18, which has several pipe segments extending down into the borehole 15 formed in an earth formation 14.

The running string 18 conveys casing or liner 30 into the borehole 15. A portion of the borehole 15 already has casing 20 set therein by cement 22. The running string 18 includes a running tool 40 and a diverter tool 50. The running string 18 lowers the liner 30 from the rig 12 at the surface 16. The diverter tool 50 is connected toward the end of the running string 18, near the running tool 40 connected to the liner 30.

The running tool 40 is releasably connected to an inner diameter of the casing 30 by a temporary attachment, such as a hanger. Fluid F can flow through the length of the bore of the running string 18 and through the casing 30. During run-in of the liner 30, the diverter tool 50 remains open with a bypass ports exposed. Surge pressure can thereby be diverted from inside the casing 30 to the borehole annulus between the running string 18 and the outer casing 20.

When the required depth is reached, a drop ball from the launcher 13*c* is pumped downhole to land in a movable ball seat (not labelled) inside the diverter tool 50. A sleeve (not labelled) in the diverter tool 50 shifts and closes the diverter tool's bypass port. A locking mechanism then locks the sleeve to seal the bypass port.

Pressure can then be increased to test any seals around the bypass ports in the diverter tool 50 and to shear the ball seat. Once freed, the ball seat rotates away into a stowed position inside the diverter tool 50 and locks in place. The diverter tool 50 is now closed and has an open full bore for passage of tools, cement plugs, darts, etc. Accordingly, operators can hang the liner 30 in the casing 20 and can perform cementation operations. During cementation, the diverter tool 50 allows darts (not shown) to be deployed through the tool 50.

Figure 2A:
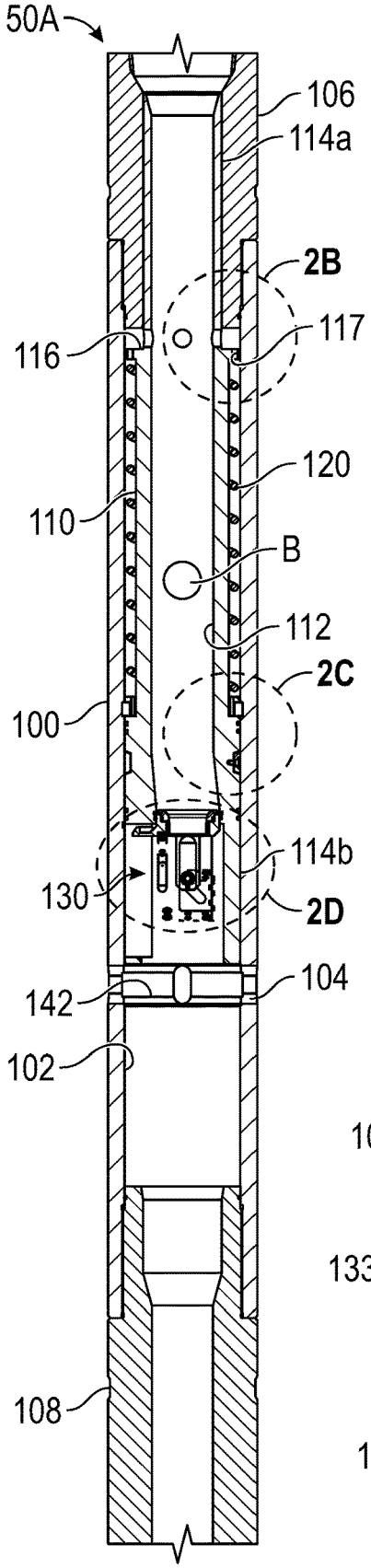
FIG. 2A illustrates a cross-sectional view of an embodiment of a diverter tool of the present disclosure.
Figure 2B:
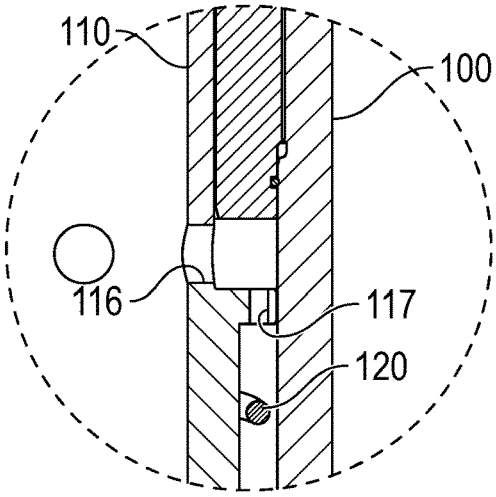
FIGS. 2B-2D illustrate details of the diverter tool in FIG. 2A.
Figure 2C:
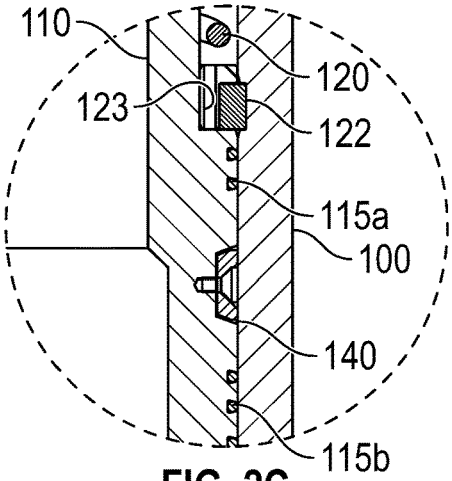
Figure 2D:
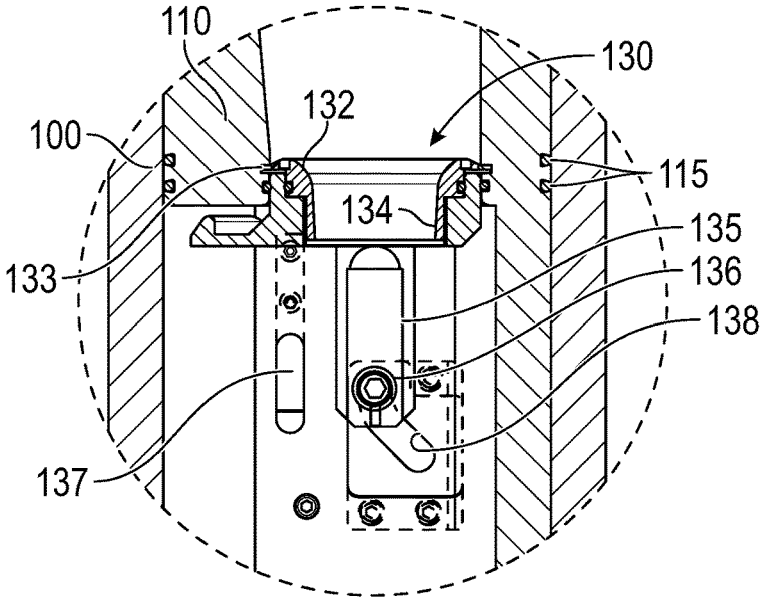

FIG. 2A illustrates a cross-sectional view of an embodiment of a diverter tool 50A of the present disclosure for use in running casing downhole with an assembly 10 as in FIG. 1. FIGS. 2B-2D illustrate details of the diverter tool 50A in FIG. 2A, and FIGS. 3A-3C illustrate the diverter tool 50A in various operational conditions.

The diverter tool 50A is used for reducing surge pressure when running casing or liner into a wellbore, as discussed above. The tool 50A is operable with a plug B (e.g., a ball) and includes a housing 100, a sleeve 110, and a seat mechanism 130. The plug B can be launched from surface from a ball launcher or the like, or the plug B may be deployed with the tool 50A and may be free to float above the seat mechanism 130.

During use, the sleeve 110 is temporarily held opened relative to one or more bypass ports 104 inside the diverter tool 50A. A running string (not shown) having the diverter tool 50A disposed thereon is used to run the casing into a wellbore. Any surge pressure passing uphole through the running string is diverted out of the bypass ports 104 in the diverter tool 50A until the casing is run to depth.

The plug B is then launched down the running string to the diverter tool 50A, and the plug B engages in a seat 132 of the seat mechanism 130 interposed in an internal bore 112 of the sleeve 110. Fluid pressure is applied against the seated plug B in the seat 132 to overcome the temporary hold that keeps the sleeve 110 in the open position. The sleeve 110 is then shifted closed relative to the bypass ports 104 by moving the sleeve 110 in the diverter tool 50A with the fluid pressure applied against the plug B seated in the seat 132.

Once the sleeve 110 shifts, the sleeve 110 is locked in a closed position. The seat 132 then pivots with the engaged plug B from the interposed position to a stowed position in the internal bore 112 of the sleeve 110. At this point, additional operations can be performed. For example, operators can pump cement down the running string and through the diverter tool 50A to cement the casing in the wellbore. Any needed cement plugs, darts, and the like can pass by the stowed seat 132 in the diverter tool 50A.

As shown in FIG. 2A, the housing 100 has a longitudinal bore 102 therethrough and has first and second ends 106, 108 for coupling to other components, such as pipe of a running string and running tool. The one or more bypass ports 104 are defined in the housing 100 and communicate the longitudinal bore 102 outside the housing 100.

The sleeve 110 is movably disposed in the longitudinal bore 102 from an opened position (FIG. 2A) open relative to the bypass ports 104 to a closed position (FIGS. 3A-3C) closed relative to the bypass ports 104. Seals 115*a-b* between the sleeve 110 and longitudinal bore 102 seal off circumferentially above and below (upbore and downbore of) the bypass ports 104 when the sleeve 110 is closed.

Figures 3A, 3B, 3C:
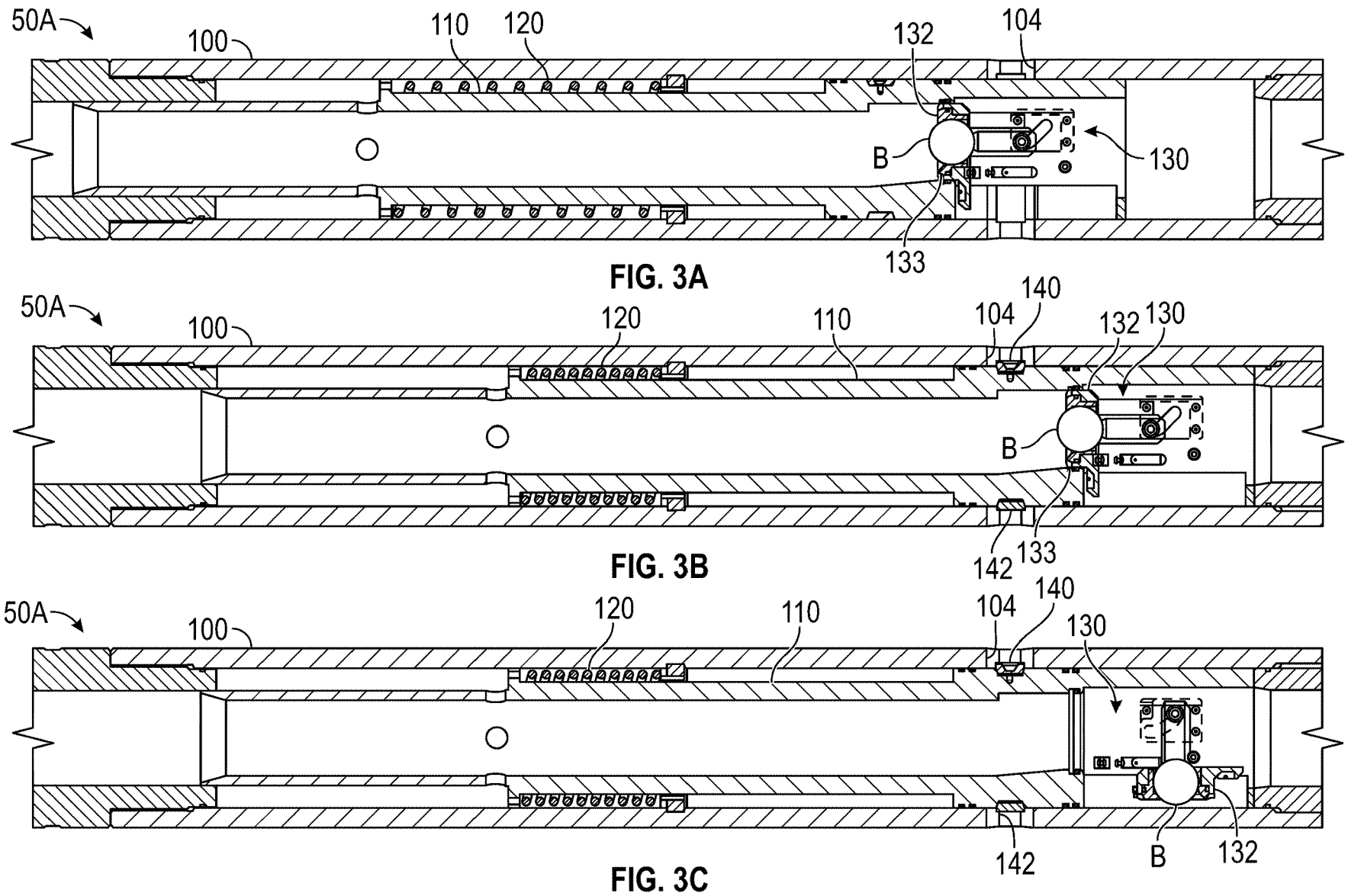
FIGS. 3A-3C illustrate the diverter tool in various operational conditions.

The sleeve 110 has an internal bore 112 therethrough, and the seat mechanism 130 is disposed in the internal bore 112 of the sleeve 110. The seat mechanism 130 includes a seat 132 with a seat opening 134 permitting fluid communication therethrough. As noted briefly above, the seat 132 is rotatable/pivotable from the interposed condition (FIGS. 3A-3B) to the stowed condition (FIG. 3C). The seat 132 in the interposed condition is interposed in the internal bore 112 and is configured to engage the plug B in the seat opening 134.

A temporary connection or fixture is disposed between the housing 100 and the sleeve 110 and holds the sleeve 110 in the opened position opened relative to the bypass ports 104. A number of temporary connections or fixtures can be used between the housing 100 and the sleeve 110. For example, shear pin, shear ring, shear plate, biasing element, spring, and the like can be disposed between the housing 100 and the sleeve 110 to hold the sleeve 110 in the opened position.

As depicted here in FIGS. 2A & 3A-3C, the tool 50A includes a biasing element 120 for this temporary connection or fixture. The biasing element 120 is disposed in an annular area between the sleeve 110 and the housing 100 and acts against a tendency of downward flow through the tool 50A from moving the sleeve 110 open. In particular, the biasing element 120 biases the sleeve 110 to the opened position (FIG. 2A) opened relative to the bypass ports 104. The biasing element 120, which can be a spring as shown, then acts against flow levels that may prematurely close the sleeve 110 before the diverter tool 50A runs the casing (not shown) to depth. Examples of the spring force for the biasing element 120 needed so circulation can pass through the tool 50A without closing the diverter tool 50A can range from about 500-lb for about 5 bpm circulation flow (mud 12.5 ppg) to over 2,100-lb. for about 10 bpm circulation flow (mud 12.5 ppg). Although the biasing element 120 is disposed toward an uphole end of the tool 50A above the seat mechanism 130 in the sleeve 110, the entire arrangement of the sleeve 110 and biasing element 120 can be reversed relative to the seat mechanism 130 and the bypass ports 104.

To prevent vacuum lock of the sleeve 110 in the housing 100, fluid can pass in the annulus between an upper member 114*a* of the sleeve 110 and the housing 110 by communicating through ports 116, 117 as shown in FIG. 2B. As further shown in FIG. 2C, fluid in the annulus can pass through ports 123 in a retainer 122 for the spring 120.

During run-in as shown in FIG. 2A, the diverter tool 50A is in an opened position with the sleeve 110 shifted uphole and with the bypass ports 104 exposed to the housing's bore 102. Fluid flow uphole through the bore 102 can be diverted out of the bypass ports 104 into the surrounding annulus, as discussed above. Meanwhile, the biasing element 120 keeps the sleeve 110 open.

As necessary, fluid flow can also pass downhole through the bore 102. For example, once the conveyed casing (not shown) reaches depth, the plug (e.g., ball B) can be pumped down the running string to the housing's bore 102. As shown in FIG. 3A, the plug B engages the seat 132 in the interposed condition in the internal bore 112 of the sleeve 110. Pumped fluid behind the seated plug B increased fluid pressure in the bore 102. Pumped fluid can also act against piston areas of the sleeve 110.

With continued pressure from the pumped fluid, the plug B can be partially extruded/captured in the seat's opening 134. Eventually, the seat 132 engaged with the plug B moves the sleeve 110 from the opened position (FIG. 2A) toward a closed position (FIGS. 3A-3C). The biasing element 120 is compressed between the sleeve's upper member 114*a* and the retainer 122. Eventually, a lock 140 engages between the sleeve 110 and the housing 100 and locks the sleeve 110 in the closed position (FIG. 3B). As best shown in FIG. 2C, the lock 140 comprises a lock ring disposed external to the sleeve 110. When the sleeve 110 is shifted, the lock ring 140 engages in an internal circumferential groove 142 defined at the bypass ports 104.

The continued pressure no longer acting to shift the sleeve 100 then actuates the seat mechanism 130. In this regard, a temporary connection or fixture between internal components of the seat mechanism 130 frees the seat 130 to rotate or pivot out of the way. Again, a number of temporary connections or fixtures between the seat 132 and the sleeve 110 can be used.

For example, as best shown in FIG. 2C, a shear ring 133 disposed about the seat 132 and engaged against a ledge 119 in the internal bore of the sleeve 110 shears in response to a level of applied fluid pressure. The ring 133 may shear at a fluid pressure limit above what it takes to move the sleeve 100. For example, the ring 133 may shear at a limit of 1600-psi or higher. By contrast, the sleeve 100 may shift closed with a fluid pressure limit of 500-psi.

Once freed, the seat 132 in the sleeve 110 in the closed position rotates/pivots from the interposed condition (FIG. 3B) to the stowed position (FIG. 3C) and exposes the internal bore 112 of the sleeve 110 to the longitudinal bore 102 of the housing 100.

The seat mechanism 130 comprises an arm 135 with a pivot 136 movable in a turned slot 138. As the freed seat 132 is pushed downward, the pivot 136 slides in the turned slot 138, and the arm 135 pivots about the pivot 136 to stow the seat 132 in the stowed condition in a side pocket 118 of the sleeve 110. As shown, the seat 132 can be heavier toward one side and/or may define a side surface area to catch passing flow to help rotate the seat 132. This may require the seat 132 to be eccentrically located in the sleeve 110, but this is not necessary depending on the size of the tool 50A.

Once pivoted, the seat 132 can then be locked in place. For example, the arm 135 can spring past a biased shoulder 137 that then holds the seat 132 stowed. In the end, the diverter tool 50A as shown in FIG. 3C provides a full bore therethrough for passage of other tools, cement plugs, darts, etc. There is no need for these additional tools, cement plugs, darts and the like used in subsequent operations to pass through a restricted ball seat. Moreover, because the plug B is stowed, there are no complications downhole that may be caused its release.

The seat mechanism 130 can include an alternative form in which the seat 132 is pivotably attached to the sleeve 110 with a hinge and pivots open in response to the required fluid pressure. In such a case, the plug B in the seat opening 134 remains exposed to the longitudinal bore 102 and could come loose should the plug B not be sufficiently extruded/captured in the opening 134. Such an arrangement may benefit from an additional sleeve (not shown) slideable in the internal bore 112 to cover the exposed plug B in the seat 132 once pivoted.

With the sleeve 110 locked in the closed position as in FIG. 3C, the tool 50A can eventually be reset once retrieved at surface by accessing the lock ring 140 through the bypass ports 104 and compressing the ring 140 to release the sleeve 110 to shift open. This ability to reset the sleeve 110 open can also be used to perform a pretest of the diverter tool 50A before it is actually run downhole to install casing. For example, operators at the surface can shift the sleeve 110 closed by mechanically overcoming the biasing element 120 so the seals and integrity of the closed tool 50A can be pretested. Once testing is complete, the tool 50A can then be reset open by compressing the ring 140 to release the sleeve 110 to shift open. The seat mechanism 130 would be left unsheared and unpivoted during the testing.

Figure 4:
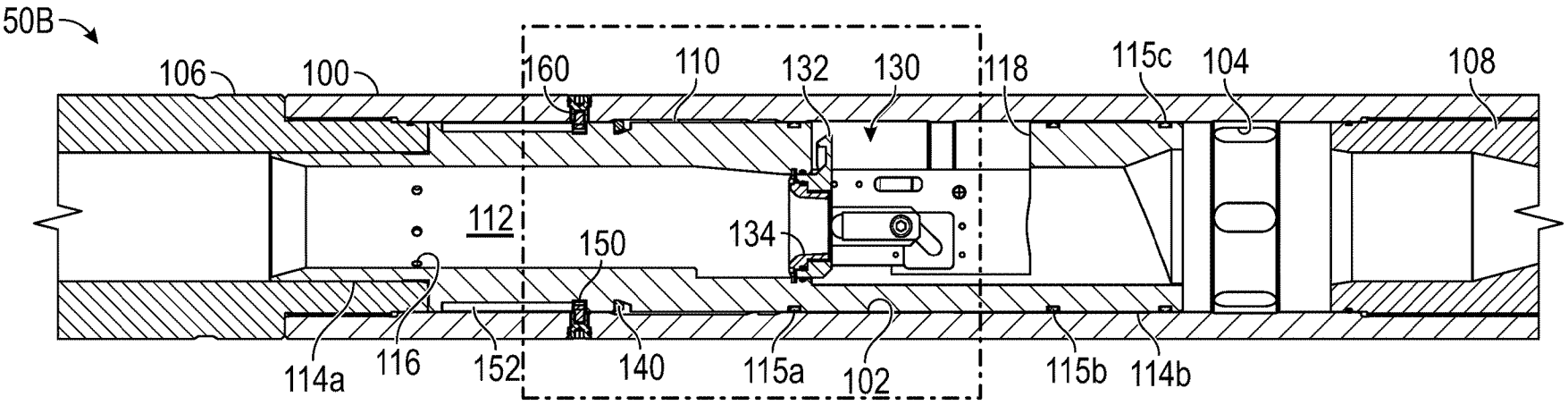
FIG. 4 illustrates a cross-sectional view of another embodiment of a diverter tool of the present disclosure.
Figure 5A:
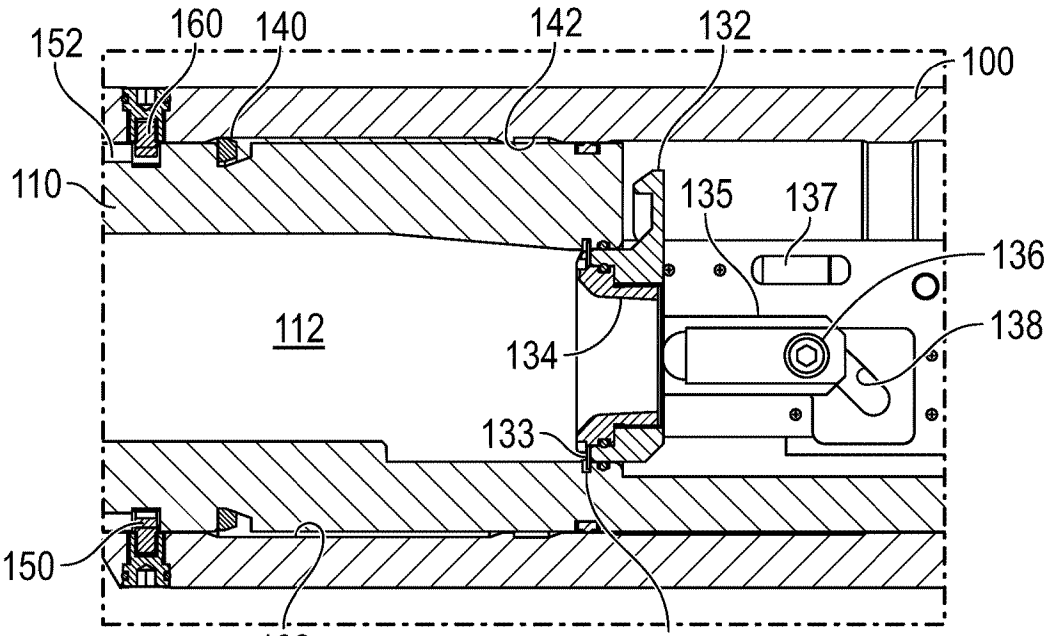
FIGS. 5A-5B illustrates cross-sectional details of the diverter tool in FIG. 4.
Figure 5B:
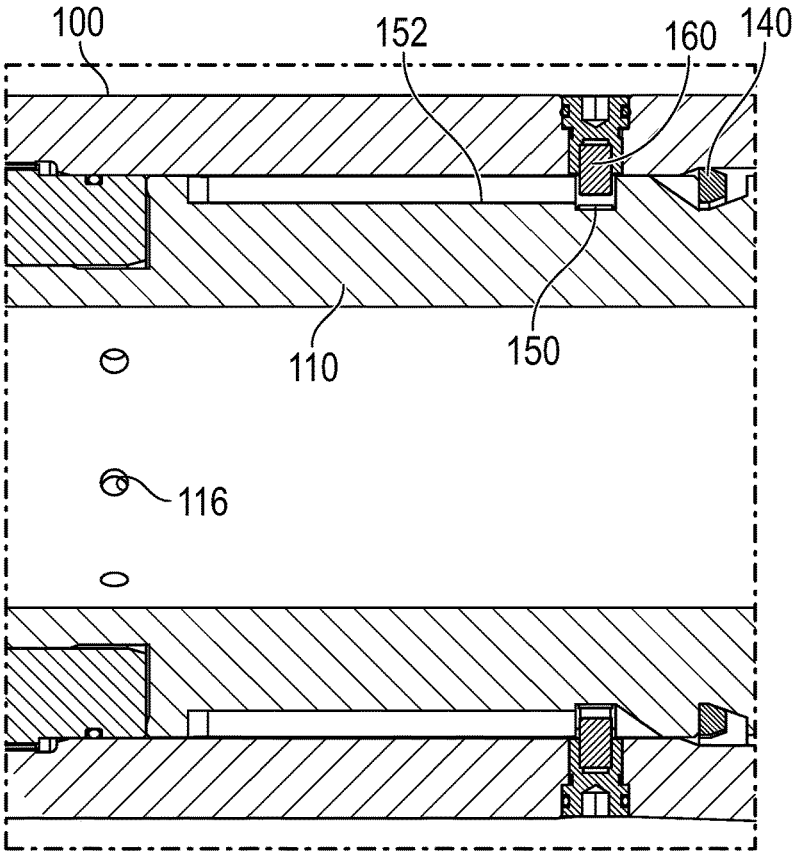
Figure 6:
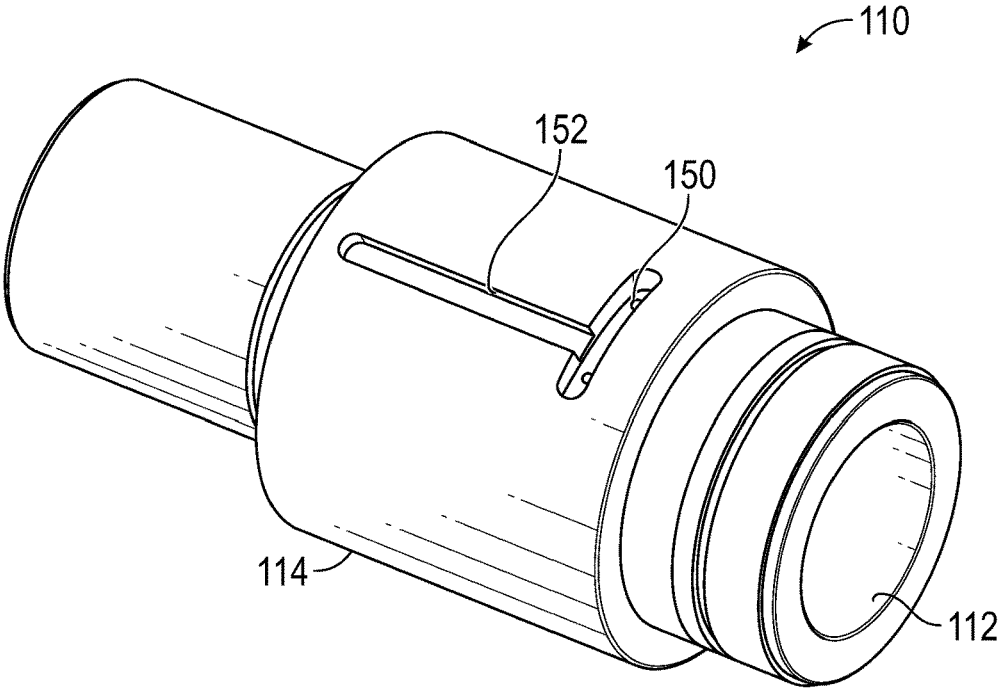
FIG. 6 illustrates a perspective view of a sleeve of the diverter tool in FIG. 4.
Figure 7A:
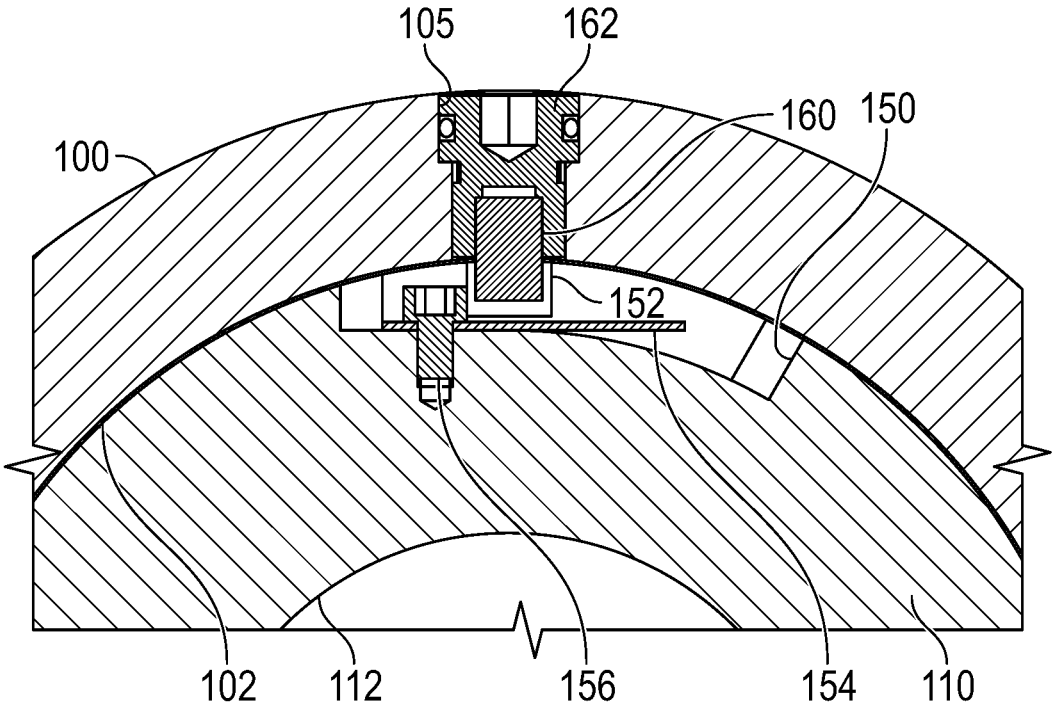
FIGS. 7A-7B illustrates end-sectional details of the diverter tool in FIG. 4.
Figure 7B:
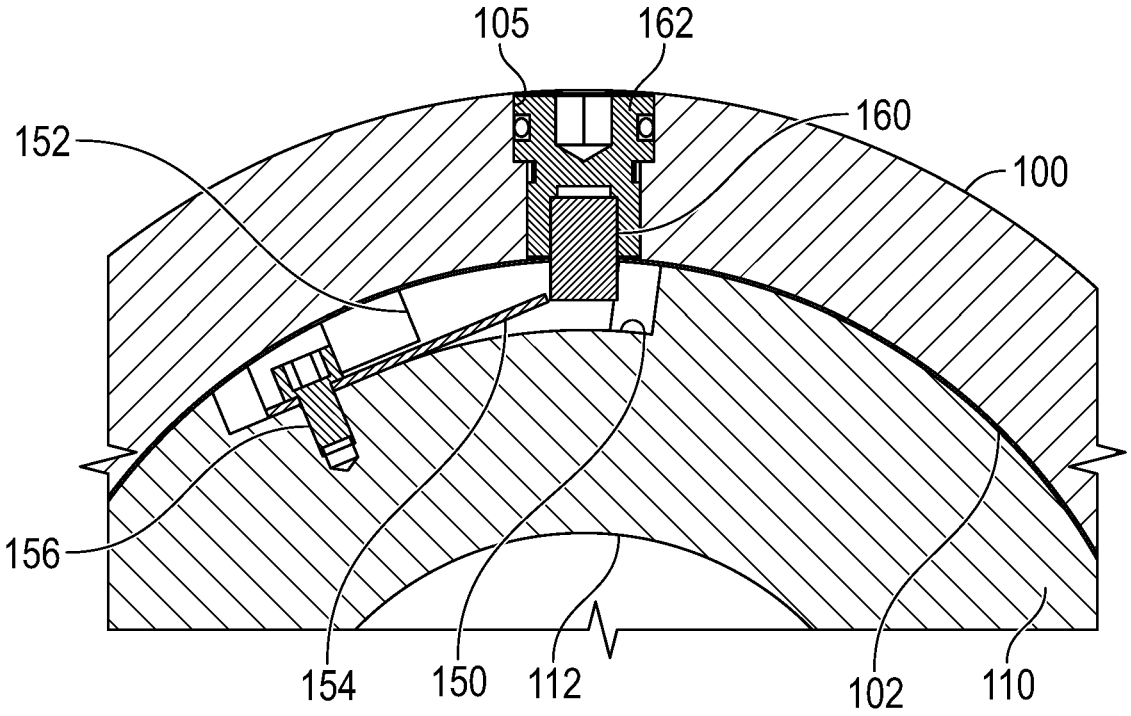

FIG. 4 illustrates a cross-sectional view of another embodiment of a diverter tool 50B of the present disclosure. FIGS. 5A-5B illustrates cross-sectional details of the diverter tool 50B in FIG. 4, FIG. 6 illustrates a perspective view of portion of a sleeve in the diverter tool 50B in FIG. 4, and FIGS. 7A-7B illustrate end-sectional details of the diverter tool 50B in FIG. 4.

Again, the diverter tool 50B is used for reducing surge pressure when running casing or liner into a wellbore, as discussed above. The tool 50B is operable with a plug (e.g., a ball) and includes a housing 100, a sleeve 110, and a seat mechanism 130. The plug B can be launched from surface from a ball launcher or the like, or the plug B may be deployed with the tool 50B and may be free to float above the seat mechanism 130.

During use, the sleeve 110 is temporarily held opened relative to one or more bypass ports 104 inside the diverter tool 50B. A running tool (not shown) having the diverter tool 50B disposed thereon is used to run the casing into a wellbore. Any surge pressure passing uphole through the running string can be diverted out of the bypass ports 104 in the diverter tool 50B until the casing is run to depth. A plug B (e.g., ball) is then launched down the running string to the diverter tool 50B (or has been run in with the tool 50B), and the plug B engages in a seat 132 of the seat mechanism 130 interposed in an internal bore 112 of the sleeve 110 in the diverter tool 50B. The sleeve 110 is shifted closed relative to the bypass ports 104 by moving the sleeve 110 in the diverter tool 50B with fluid pressure applied against the plug B seated in the seat 132.

Once the sleeve 110 shifts, the sleeve 110 is locked closed. The seat 132 then rotates/pivots with the engaged plug B from an interposed position to a stowed position in the internal bore 112 of the sleeve 110. At this point, additional operations can be performed. For example, operators can pump cement down the running string and through the diverter tool 50B to cement the casing in the wellbore. Any needed cement plugs, darts, and the like can pass by the stowed seat 132 in the diverter tool 50B.

As shown in FIG. 4, the housing 100 has a longitudinal bore 102 therethrough and has first and second ends 106, 108 for coupling to other components, such as pipe of a running string and running tool. The one or more bypass ports 104 are defined in the housing 100 and communicate the longitudinal bore 102 outside the housing 100.

The sleeve 110 is movably disposed in the longitudinal bore 102 from an opened position (FIG. 4) open relative to the bypass ports 104 to a closed position closed relative to the bypass ports 104. Again, seals 115*a-b* between the sleeve 110 and longitudinal bore 102 seal off circumferentially above and below (upbore and downbore of) the bypass ports 104 when the sleeve 110 is closed.

The sleeve 110 has an internal bore 112 therethrough, and the seat mechanism 130 is disposed in the internal bore 112 of the sleeve 110. The seat mechanism 130 includes a seat 132 with a seat opening 134 permitting fluid communication therethrough. In contrast to the previous arrangement of FIG. 2A in which the seat 132 is positioned downhole of the seals 115*a-b* for sealing off the ports 104, the seat 132 for the tool 50B of FIG. 4 is positioned uphole of the seals 115*a-b* for sealing off the ports 104. This means that the sleeve 110 can be shorter and that the sleeve 110 requires less shifting for the lower member 114*b* of the sleeve 110 to seal off the ports 104.

As noted briefly above, the seat 132 is rotatable/pivotable from the interposed condition (FIG. 4) to the stowed condition. The seat 132 in the interposed condition is interposed in the internal bore 112 and is configured to engage the dropped plug B in the seat opening 134 in a manner similar to that discussed above.

A temporary connection or fixture is disposed between the housing 100 and the sleeve 110 and holds the sleeve 110 in the opened position (FIG. 4) opened relative to the bypass ports 104. A number of temporary connections or fixtures between the housing 100 and the sleeve 110 can be used. In contrast to the previous embodiment, the tool 50B does not include a biasing element. Instead, the sleeve 110 is held with a temporary connection or fixture using one or more radially arranged shear pins 160 of the housing 100 disposed in one or more external slots 150 in the sleeve 110. The radially arranged shear pins 160 are configured to shear in response to fluid pressure applied against the ball seated in the seat 132 of the tool 50B, as discussed below. As will be appreciated with the benefit of the present disclosure, devices other than shear pins 160 can be used for the temporary fixture. For example, shear screws, shear rings, shear plates, and the like disposed between the housing 100 and the sleeve 110 can hold the sleeve 110 in the opened position opened relative to the bypass ports 104.

To prevent vacuum lock of the sleeve 110 in the housing 100, fluid can pass in the annulus between an upper member 114*a* of the sleeve 110 and the housing 110 by communicating through upper cross ports 116.

During run-in as shown in FIG. 4, the diverter tool 50B is in an opened condition with the sleeve 110 shifted uphole and with the bypass ports 104 exposed to the housing's bore 102. Fluid flow uphole through the bore 102 can be diverted out of the bypass ports 104 into the surrounding annulus, as discussed above. Meanwhile, the radial pins 160 keep the sleeve 110 open.

As necessary, fluid flow can also pass downhole through the bore 102. For example, once the conveyed casing (not shown) reaches depth, a plug B (e.g., ball) is pumped down the running string to the housing's bore 102. The plug B engages the seat 132 in the interposed condition in the internal bore 112 of the sleeve 110. Pumped fluid behind the seated plug B increases fluid pressure in the bore 102. Pumped fluid can also act against piston areas of the sleeve 110.

Continued applied pressure eventually shears the sleeve 110 free of the radial pins 160, and the sleeve 110 shifts down to close the bypass ports 104. In particular, the seat 132 engaged with the dropped plug B forces the sleeve 110 in the opened position (FIG. 4) toward a closed position. The radially arranged pins 160 shear and free the sleeve 110 to shift from the opened position (FIG. 4) toward the closed position. Eventually, a lock 140 engages between the sleeve 110 and the housing 100 and locks the sleeve 110 in the closed position. As shown here, the lock 140 comprises a split ring disposed external to the sleeve 140 for engaging in a circumferential groove 142 defined inside the bore 102 of the housing 100.

The lower member 114*b* of the sleeve 110 shoulders against the housing's downhole end 108 and seals off the ports 104 with seals 115*a-b*. The continued pressure no longer acting to shift the sleeve 110 then actuates the seat mechanism 130. A temporary fixture between internal components of the seat mechanism 130 shears free. Again, a number of temporary connections or fixtures between the seat 132 and the sleeve 110 can be used.

For example, as best shown in FIG. 5A, a shear ring 133 disposed about the seat 132 and engaged against a ledge 119 in the internal bore of the sleeve 110 shears in response to a level of applied fluid pressure. Once freed, the seat 132 in the sleeve 110 in the closed position rotates from the interposed condition (FIGS. 4 & 5A) to a stowed position and exposes the internal bore 112 of the sleeve 110 to the longitudinal bore 102 of the housing 100 in a manner similar to that discussed above.

Again, the seat mechanism 130 comprises an arm 135 with a pivot 136 movable in a turned slot 138. As the freed seat 132 is pushed downward, the pivot 136 slides in the turned slot 138, and the arm 135 pivots about the pivot 136 to stow the seat 132 in the stowed condition in a side pocket 118. The seat 132 can then be locked in place. For example, the arm 135 can spring past a biased shoulder 137 that then holds the seat 132 stowed.

In the end, the diverter tool 50B provides a full bore therethrough for passage of other tools, cement plugs, darts, etc. There is no need for these additional tools, cement plugs, darts and the like used in subsequent operations to pass through a restricted ball seat. Moreover, because the plug B is stowed, there are no complications downhole that may be caused by a released ball.

The seat mechanism 130 can include an alternative form in which the seat 132 is pivotably attached to the sleeve 110 with a hinge and pivots open in response to the required fluid pressure. In such a case, the plug B in the seat opening 134 remains exposed to the longitudinal bore 102 and could come loose should the plug B not be sufficiently extruded/captured in the opening 134. Such an arrangement may benefit from an additional sleeve (not shown) slideable in the internal bore 112 to cover the exposed plug B in the seat 132 once pivoted.

With the sleeve 110 locked in the closed position, the tool 50B can eventually be reset once retrieved at surface by overcoming the lock of the lock ring 140 to release the sleeve 110 to shift open.

To allow for initial assembly and testing of the sleeve 110 in the housing 110, each of the shear pins 160 can be disposed in a slot 150 in the sleeve 110 that is transverse (i.e., the slots 150 extends circumferentially about the outside of the sleeve 110). Each transverse slot 150 can further comprise a longitudinal slot 152 extending therefrom in which the radial pin 160 is movable along. Looking at FIG. 5B, portion of the sleeve's upper member 114*a* in the housing 100 is illustrated in side cross-section showing shear pins 160 disposed in the transverse slot 150 at the end of the longitudinal slot 152. FIG. 6 shows the sleeve's upper member 114*a* in an isolated perspective view, showing the transverse slot 150 having the longitudinal slot 152 extending therefrom.

As shown in FIG. 7A, the transverse slot 150 includes a retainer clip 154. During assembly steps, the retainer clip 154 permit passage of the radial pin 160 in a first (clockwise) direction into the transverse slot 150 from a proximal end the longitudinal slot 152. With the sleeve's upper member 114*a* then configured for use as in FIG. 7B, the retainer clip 154 prevent passage of the radial pin 160 in a second (counterclockwise) direction opposite the first direction. As shown, the radial pin 160 can be held with a retainer 162 threaded and sealed in an external aperture 105 of the housing 100. For its part, the retainer clip 154 is held in the transverse slot 150 with a retention pin 156.

With this configuration of slots 150, 152, retainer clips 154, and pins 160, the diverter tool SOB during assembly can first be set up for internal pressure testing. To do this, the sleeve 110 is shifted in the tool SOB to an internal pressure test position. For this position, the radial pins 160 are situated in the upper ends of the longitudinal slots 152 of the sleeve's upper member 114*a* with the sleeve 110 shifted to a closed condition relative to the bypass ports 104. Fluid pressure down the bore 102 of the housing 100 can test the pressure integrity of seals in the tool SOB, such as the seals 115*a-b* sealing between the sleeve's lower member 114*b* and the bypass ports 104. The seat mechanism 130 remains unsheared and unpivoted in the testing.

After testing, the tool 50B can then be placed in an operational condition, as shown in FIG. 4. To do this, the sleeve 110 is pulled upward in the housing 100 and is rotated a partial turn clockwise. When the sleeve 110 is pulled, the radial pins 160 ride along the longitudinal slots 152 and reach the retainer clips 154, as shown in FIG. 7A. Then, when the sleeve 110 is turned as shown in FIG. 7B, the radial pins 160 spring past the retainer clips 154, which then prevent the sleeve 110 from rotating counterclockwise in a manner discussed above.

Although less desirable in terms of machining and assembly, the arrangement of pins 160 and slots 150 between the sleeve 110 and the housing 100 can be reversed. In this case, the longitudinal bore 102 of the housing 100 can define the slots 150, and the sleeve 110 can have the pins 160 extending radially outward for engagement in the slots.

Figure 8A:
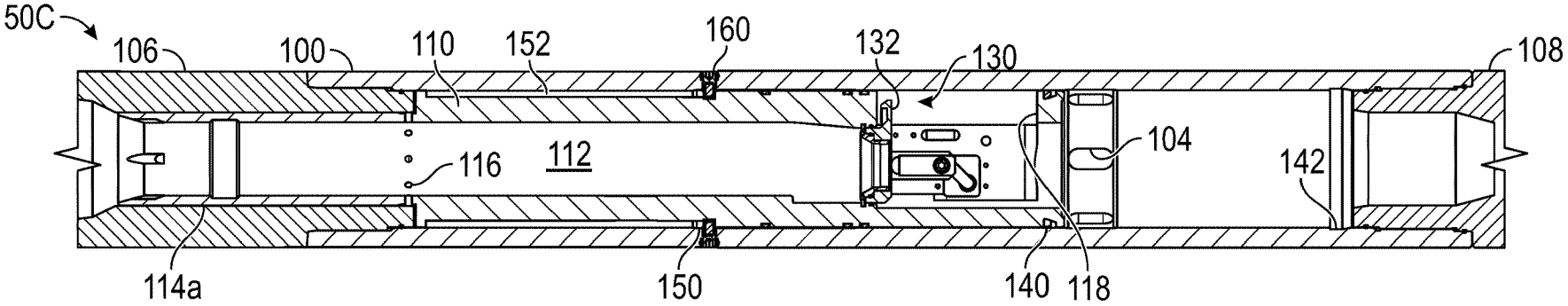
FIG. 8A illustrates a cross-sectional view of yet another embodiment of a diverter tool of the present disclosure.
Figure 8B:
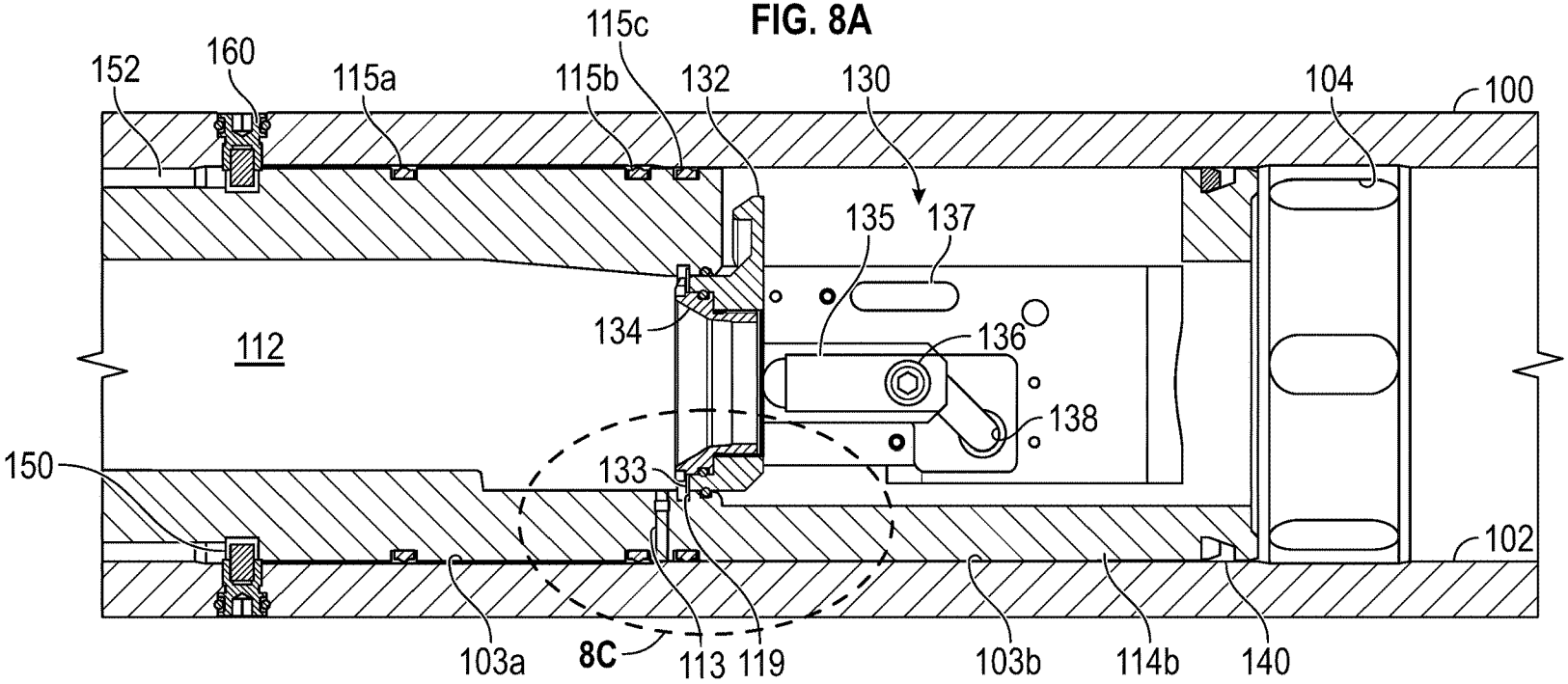
FIGS. 8B-8C illustrate details of the diverter tool in FIG. 8A.
Figure 8C:
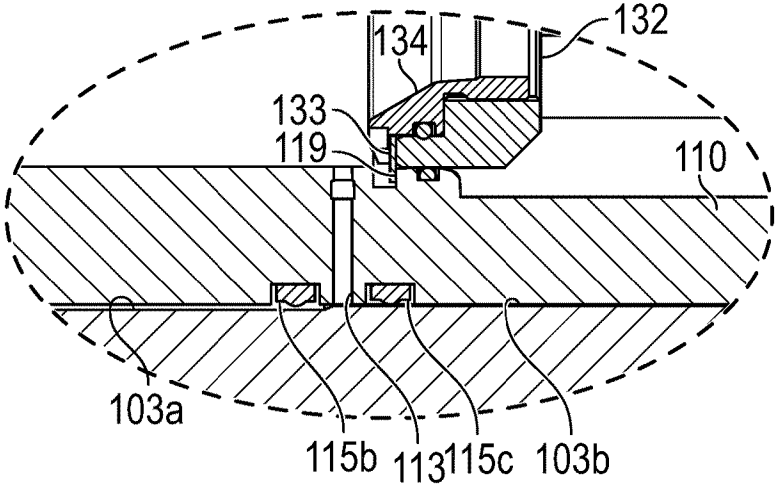
Figure 9A:
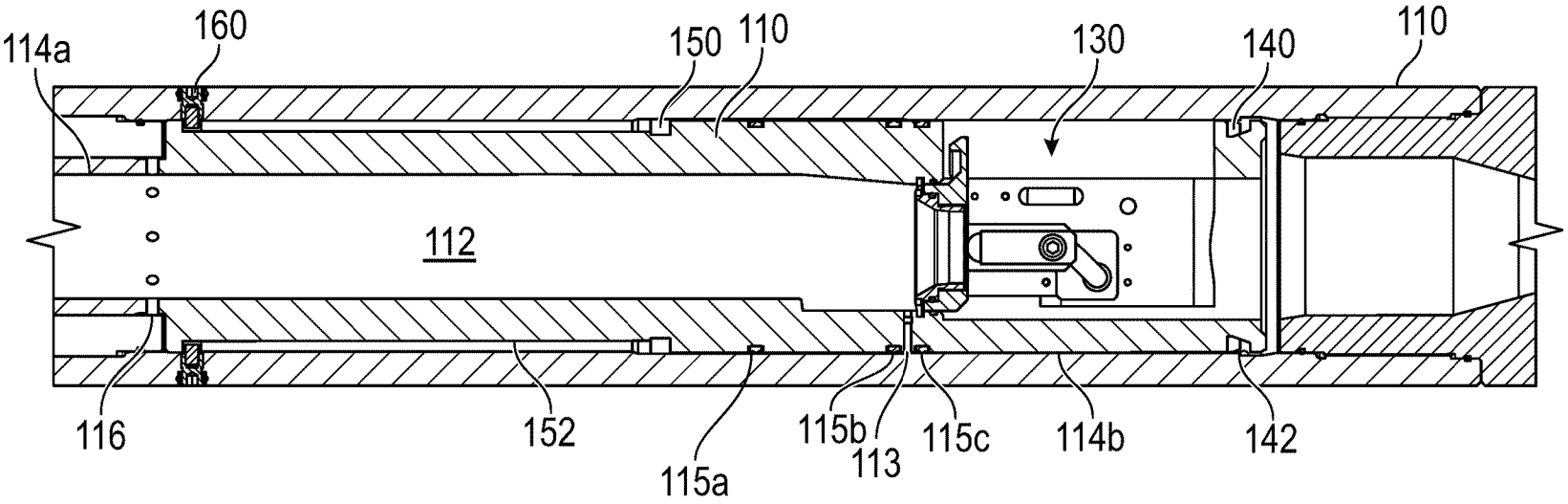
FIGS. 9A-9C illustrate cross-sectional details of the diverter tool during stages of operation.
Figure 9B:
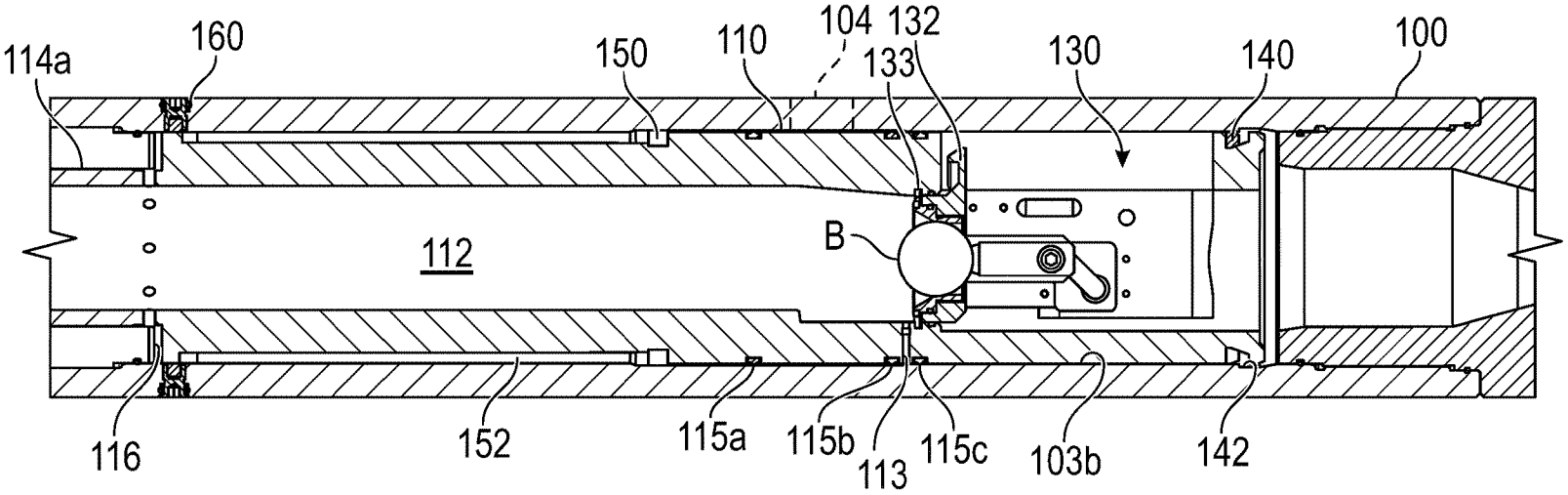
Figure 9C:
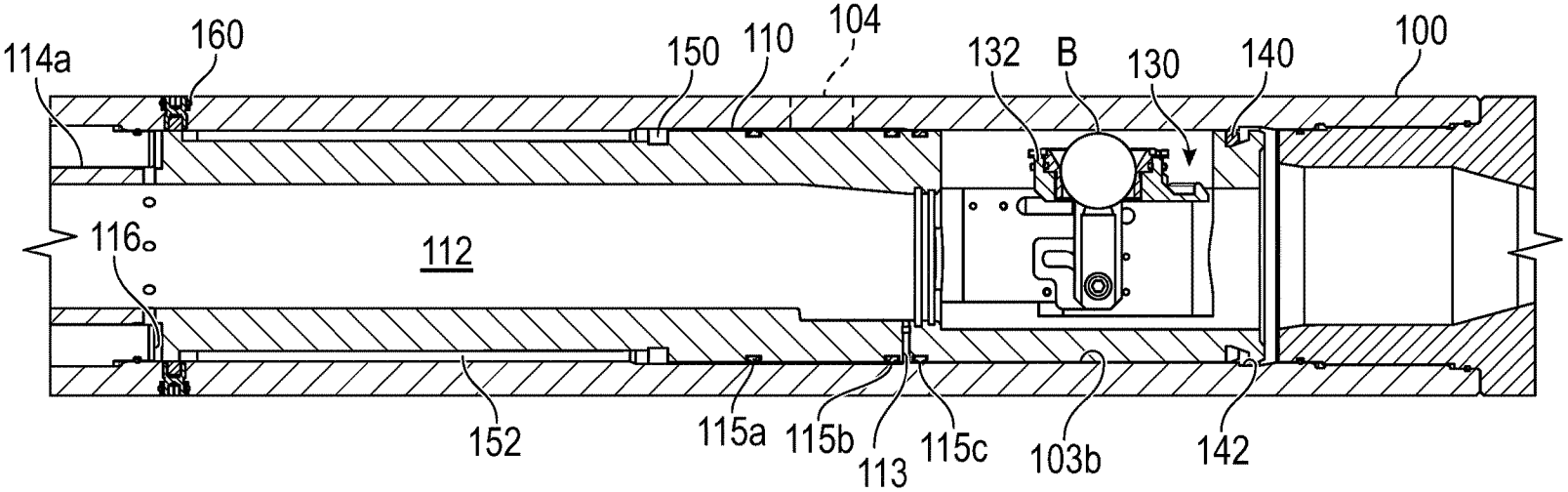

FIG. 8A illustrates a cross-sectional view of yet another embodiment of a diverter tool 50C of the present disclosure. FIGS. 8B-8C illustrate details of the diverter tool 50C in FIG. 8A. Finally, FIGS. 9A-9C illustrate cross-sectional details of the diverter tool 50C during stages of operation.

Again, the diverter tool 50C is used for reducing surge pressure when running casing or liner into a wellbore, as discussed above. The tool 50C is operable with a plug (e.g., a ball B) and includes a housing 100, a sleeve 110, and a seat mechanism 130. The plug B can be launched from surface with a ball launcher or the like, or the plug B may be deployed with the tool 50C and may be free to float above the seat mechanism 130. Many of the features of the diverter tool 50C are similar to those discussed above with reference to FIGS. 4 through 7B.

Briefly, the sleeve 110 during use is temporarily held opened relative to one or more bypass ports 104 inside the diverter tool 50C (FIG. 8A). A running tool (not shown) having the diverter tool 50C disposed thereon is used to run the casing into a wellbore. Any surge pressure passing uphole through the running string can be diverted out of the bypass ports 104 in the diverter tool 50C until the casing is run to depth. A plug B (e.g., ball) is then launched down the running string to the diverter tool 50C (or has been run in with the tool 50C), and the plug B engages in a seat 132 of the seat mechanism 130 interposed in an internal bore 112 of the sleeve 110 in the diverter tool SOB. The sleeve 110 is shifted closed relative to the bypass ports 104 by moving the sleeve 110 in the diverter tool 50C with fluid pressure applied against the plug B seated in the seat 132 (FIG. 9B).

Once the sleeve 110 shifts, the sleeve 110 is locked closed. The seat 132 then rotates/pivots with the engaged plug B from an interposed position to a stowed position in the internal bore 112 of the sleeve 110 (FIG. 9C). At this point, additional operations can be performed. For example, operators can pump cement down the running string and through the diverter tool 50C to cement the casing in the wellbore. Any needed cement plugs, darts, and the like can pass by the stowed seat 132 in the diverter tool 50C.

As shown in FIG. 8A, the housing 100 has a longitudinal bore 102 therethrough and has first and second ends 106, 108 for coupling to other components, such as pipe of a running string and running tool. The one or more bypass ports 104 are defined in the housing 100 and communicate the longitudinal bore 102 outside the housing 100.

The sleeve 110 is movably disposed in the longitudinal bore 102 from an opened position (e.g., FIG. 8A) open relative to the bypass ports 104 to a closed position (e.g., FIG. 9B-9C) closed relative to the bypass ports 104. Again, seals 115*a-b* between the sleeve 110 and longitudinal bore 102 seal off circumferentially above and below (upbore and downbore of) the bypass ports 104 when the sleeve 110 is closed.

The sleeve 110 has an internal bore 112 therethrough, and the seat mechanism 130 is disposed in the internal bore 112 of the sleeve 110. The seat mechanism 130 includes a seat 132 with a seat opening 134 permitting fluid communication therethrough. In contrast to the previous arrangement of FIG. 4, the seat 132 is positioned downhole of the seals 115*a-b* for sealing off the ports 104. This means that the sleeve 110 may be longer and that the sleeve 110 may require more shifting for the lower member 114*b* of the sleeve 110 to seal off the ports 104.

As noted briefly above, the seat 132 is rotatable/pivotable from the interposed condition (FIGS. 8A-8C) to the stowed condition (FIG. 9C). The seat 132 in the interposed condition is interposed in the internal bore 112 and is configured to engage the plug B in the seat opening 134 in a manner similar to that discussed above.

A temporary connection or fixture is disposed between the housing 100 and the sleeve 110 and holds the sleeve 110 in the opened position (FIGS. 8A-8C) opened relative to the bypass ports 104. A number of temporary connections or fixtures between the housing 100 and the sleeve 110 can be used. Similar to the previous embodiment, the sleeve 110 is held with a temporary connection or fixture using one or more radially arranged shear pins 160 of the housing 100 disposed in one or more external slots 150 in the sleeve 110. The radially arranged shear pins 160 are configured to shear in response to fluid pressure applied against the ball seated in the seat 132 of the tool 50C, as discussed below. As will be appreciated with the benefit of the present disclosure, devices other than shear pins 160 can be used for the temporary fixture. For example, shear screws, shear rings, shear plates, and the like disposed between the housing 100 and the sleeve 110 can hold the sleeve 110 in the opened position opened relative to the bypass ports 104.

During run-in as shown in FIG. 8A, the diverter tool 50C is in an opened condition with the sleeve 110 shifted uphole and with the bypass ports 104 exposed to the housing's bore 102. Fluid flow uphole through the bore 102 can be diverted out of the bypass ports 104 into the surrounding annulus, as discussed above. Meanwhile, the radial pins 160 keep the sleeve 110 open. To prevent vacuum lock of the sleeve 110 in the housing 100, fluid can pass in the annulus between an upper member 114*a* of the sleeve 110 and the housing 110 by communicating through upper cross ports 116.

As necessary, fluid flow can also pass downhole through the bore 102. For example, once the conveyed casing (not shown) reaches depth, a plug B (e.g., ball) is pumped down the running string to the housing's bore 102. The plug B engages the seat 132 in the interposed condition in the internal bore 112 of the sleeve 110. Pumped fluid behind the seated plug B increases fluid pressure in the bore 102. Pumped fluid can also act against piston areas of the sleeve 110.

Continued applied pressure eventually shears the sleeve 110 free of the radial pins 160, and the sleeve 110 shifts down to close the bypass ports 104. In particular, the seat 132 engaged with the plug B forces the sleeve 110 in the opened position (FIGS. 8A-8C) toward a closed position (FIG. 9B). The radially arranged pins 160 shear and free the sleeve 110 to shift from the opened position (FIGS. 8A-8C) toward the closed position (FIG. 9B). Eventually, a lock 140 engages between the sleeve 110 and the housing 100 and locks the sleeve 110 in the closed position. As shown here, the lock 140 comprises a split ring disposed external to the sleeve 140 for engaging in a circumferential groove 142 defined inside the bore 102 of the housing 100.

As shown in FIG. 9B, the lower member 114*b* of the sleeve 110 shoulders against the housing's downhole end 108 and seals off the ports 104 with the seals 115*a-b*. The continued pressure no longer acting to shift the sleeve 110 then actuates the seat mechanism 130 as shown in FIG. 9C. A temporary fixture between internal components of the seat mechanism 130 shears free. Again, a number of temporary connections or fixtures between the seat 132 and the sleeve 110 can be used.

For example, as best shown in FIGS. 8B-8C, a shear ring 133 disposed about the seat 132 and engaged against a ledge 119 in the internal bore of the sleeve 110 can shear in response to a level of applied fluid pressure. Once freed, the seat 132 in the sleeve 110 in the closed position rotates from the interposed condition (FIG. 9B) to a stowed position (FIG. 9C) and exposes the internal bore 112 of the sleeve 110 to the longitudinal bore 102 of the housing 100 in a manner similar to that discussed above.

Again, the seat mechanism 130 comprises an arm 135 with a pivot 136 movable in a turned slot 138. As the freed seat 132 is pushed downward, the pivot 136 slides in the turned slot 138, and the arm 135 pivots about the pivot 136 to stow the seat 132 in the stowed condition in a side pocket 118. The seat 132 can then be locked in place. For example, the arm 135 can spring past a biased shoulder 137 that then holds the seat 132 stowed.

In the end, the diverter tool 50C provides a full bore therethrough for passage of other tools, cement plugs, darts, etc. There is no need for these additional tools, cement plugs, darts and the like used in subsequent operations to pass through a restricted ball seat. Moreover, because the plug B is stowed, there are no complications downhole that may be caused by a released ball.

The seat mechanism 130 can include an alternative form in which the seat 132 is pivotably attached to the sleeve 110 with a hinge and pivots open in response to the required fluid pressure. In such a case, the plug B in the seat opening 134 remains exposed to the longitudinal bore 102 and could come loose should the plug B not be sufficiently extruded/captured in the opening 134. Such an arrangement may benefit from an additional sleeve (not shown) slideable in the internal bore 112 to cover the exposed plug B in the seat 132 once pivoted.

With the sleeve 110 locked in the closed position, the tool 50C can eventually be reset once retrieved at surface by overcoming the lock of the lock ring 140 to release the sleeve 110 to shift open.

To allow for initial assembly and testing of the sleeve 110 in the housing 110, each of the shear pins 160 can be disposed in a slot 150 in the sleeve 110 that is transverse (La, the slots 150 extends circumferentially about the outside of the sleeve 110). Each transverse slot 150 can further comprise a longitudinal slot 152 as shown in FIGS. 8A-8B extending therefrom in which the radial pin 160 is movable along. Features of the transverse slots 150, the longitudinal slots 152, the radial pins 160, retainers (162), retainer clips (154), retention pins (156), etc. for this tool 50C can be similar to the features discussed above with reference to the other diverter tool 50B as in FIGS. 7A-7B so that they are not repeated here.

As before with this configuration of slots 150, 152, retainer clips (154), pins 160, etc., this diverter tool 50C can first be set up for internal pressure testing during assembly. To do this as shown in FIG. 9A, the sleeve 110 is shifted in the tool 50C to an internal pressure test position before the radial pins 160 are retained in the transverse slots 150. For this position, the radial pins 160 are situated in the upper ends of the longitudinal slots 152 of the sleeve's upper member 114*a* with the sleeve 110 shifted to a closed condition relative to the bypass ports 104. Fluid pressure down the bore 102 of the housing 100 can test the pressure integrity of seals in the tool 50C, such as the seals 115*a-b* sealing between the sleeve's lower member 114*b* and the bypass ports 104. The seat mechanism 130 remains unsheared and unpivoted in the testing.

After testing, the tool 50C can then be placed in its operational condition, as shown in FIG. 8A. To do this, the sleeve 110 is pulled upward in the housing 100 and is rotated a partial turn clockwise. When the sleeve 110 is pulled, the radial pins 160 ride along the longitudinal slots 152 and reach the retainer clips (154). Then, when the sleeve 110 is turned, the radial pins 160 spring past the retainer clips (154), which then prevent the sleeve 110 from rotating counterclockwise in a manner discussed above.

With the tool 50C set in the operational condition as shown in FIGS. 8A-8C, the upper seal 115*a* is not exposed to a pressure differential so damage to the seal 115*a* can be mitigated. The upper seal 115*a* can thereby remain ready for eventual use. In particular, the upper seal 115*a* as shown in FIG. 8B on the sleeve 110 is disposed at an increased section 103*a* of the housing's bore 102. Tubing pressure in the tool 50C entering the upper cross ports 116 on the sleeve's upper member 114*a* can reach the upper seal 115*a* and can act in the annulus between the sleeve 110 and bore 102 on one of the sides of the upper seal 115*a*. Meanwhile, tubing pressure in the tool 50C can also enter a lower cross port 113 in the sleeve 110 near the seat 130 and can reach the upper seal 115*a* to act in the annulus between the sleeve 110 and bore 102 on the seal's other side. In a similar way, the lower seal 115*b* is not exposed to a pressure differential because the tubing pressure is similarly communicated to both sides of the seal 115*b* in the annulus between the sleeve 110 and bore 102. The lower seal 115*b* can thereby remain ready for eventual use.

A third seal 115*c*, however, in the operational condition does engage a polished surface 103*b* of the housing's bore 102. This third seal 115*c* can ensure that tubing pressure entering the lower cross port 113 does not leak further downhole. The lower cross port 113 can be sized so as to not become plugged with debris from operation fluids. Moreover, the lower cross port 113 could be packed with grease, or other features could be used.

The arrangement of the seals 115*a-c* and the lower cross port 113 allow the seals 115*a-b* to be tested during assembly as in FIG. 9A. Also, the arrangement allows the seals 115*a-b* to be tested during the process of closing the sleeve 110. As shown in FIG. 9B, the plug B has been engaged in the seat 132, and fluid pressure applied against the seated plug B has sheared the shear pins 160. As a result, the sleeve 110 has shifted closed so that the seals 115*a-b* engage the polished bore surface 130*b* and straddle the bypass port 104. Before shearing the seat 132 free with increased pressure, the seals 115*a-b* in FIG. 9B are subject to a pressure differential that allows their integrity to be determined.

In particular, the upper seal 115*a* engages the bore surface 103*b* above (upbore of) the bypass port 104 so that the seal 115*a* is exposed to tubing pressure communicated from the sleeve's upper cross ports 116 and is exposed to borehole pressure communicated from the housing's port 104. The lower seal 115*b* engages the bore surface 103*b* below (downbore of) the bypass port 104 so that the seal 115*b* is exposed to tubing pressure communicated from the sleeve's lower cross port 113 and to borehole pressure communicated from the housing's port 104. Identified leakage can indicate that the integrity of the seals 115*a-b* is compromised so that operators can take remedial actions. As is understood, knowing the integrity of the seals 115*a-b* both before deployment and during use downhole can prevent a number of disadvantageous outcomes.

For its part, the third seal 115*c* could conceivably fail, which may allow for leakage of tubing pressure downhole. From surface, this leakage of the third seal 115*c* may be confused as being leakage from the primary seals 115*a-b* even though the primary seals 115*a-b* are functionally normally. For this reason, additional seals could be provided as a redundancy to at least this third seal 115*c*. Of course, any number of redundant seals could be used for the seals 115*a-c*.

Eventually, with the seals 115*a-b* sealing the ports 104, the increased fluid pressure can shear the seat 132 free to pivot from the interposed condition (FIG. 9B) to the stowed position (FIG. 9C). The tool 50C as shown in FIG. 9C is now closed and provides a fullbore for passage of cementing tools and the like during further operations.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A diverter tool for reducing surge pressure when running casing into a wellbore, the tool operable with a plug and comprising:

a housing having a longitudinal bore therethrough, the housing defining a bypass port communicating the longitudinal bore outside of the housing;

a sleeve movably disposed in the longitudinal bore and having an internal bore therethrough, the sleeve being movable in the longitudinal bore from an opened position open relative to the bypass port to a closed position closed relative to the bypass port; and a seat disposed in the internal bore of the sleeve and being movable with the sleeve in the longitudinal bore of the housing, the seat defining a seat opening permitting fluid communication therethrough, the seat being rotatable in the internal bore from an interposed condition to a stowed condition, the seat in the interposed condition interposed in the internal bore and configured to engage the plug in the seat opening, the seat in the interposed condition engaged with the plug being configured to move the sleeve from the opened position to the closed position in response to applied fluid pressure in the longitudinal bore, the seat in the sleeve in the closed position being configured to rotate from the interposed condition to the stowed position and being configured to expose the internal bore of the sleeve to the longitudinal bore of the housing.

2. The tool of claim 1, comprising a lock disposed between the sleeve and the housing and locking the sleeve in the closed position.

3. The tool of claim 2, wherein the lock comprises a snap ring disposed about the sleeve and engaging in a circumferential shoulder defined in the longitudinal bore.

4. The tool of claim 1, wherein the seat comprises an arm connected to the seat and having a pivot point disposed in a slot, the pivot point moveable in the slot and permitting the arm to rotate the seat from the interposed condition to the stowed position.

5. The tool of claim 4, wherein the sleeve defines a side pocket of the internal bore in which the seat rotates in the stowed condition.

6. The tool of claim 1, comprising a temporary fixture disposed between the sleeve and the housing and temporarily holding the sleeve in the opened position up to a first limit of the applied fluid pressure, the temporary fixture releasing the sleeve to move from the opened position to the closed position in response to the first limit of the applied fluid pressure acting thereagainst.

7. The tool of claim 6, wherein the temporary fixture comprises a biasing element biasing the sleeve to the opened position and acting against a level below the first limit of the applied fluid pressure tending to prematurely close the sleeve.

8. The tool of claim 6, wherein the temporary fixture comprises one or more radial pins disposed in the longitudinal bore of the housing and shearably engaging the sleeve.

9. The tool of claim 8, wherein the sleeve defines one or more first slots each having one of the one or more radial pins retained therein.

10. The tool of claim 9, wherein each of the one or more first slots comprises a second slot extending therefrom in which the radial pin is movable longitudinally along.

11. The tool of claim 10, wherein each of the one or more first slots comprises a retainer clip permitting passage of the radial pin in a first direction into the first slot from a proximal end the second slot and preventing passage of the radial pin in a second direction opposite the first direction.

12. The tool of claim 1, comprising a temporary fixture disposed between the seat and the sleeve and holding the seat in the interposed condition up to a second limit of the applied fluid pressure, the temporary fixture releasing the seat to move from the interposed condition to the stowed condition in response to the second limit of the applied fluid pressure acting thereagainst.

13. The tool of claim 12, wherein the temporary fixture comprises a shear ring disposed between the seat and a ledge in the internal bore of the sleeve.

14. The tool of claim 1, further comprising a lock locking the seat in the stowed position.

15. The tool of claim 14, wherein the lock comprises a biased first shoulder disposed in the internal bore of the sleeve and engaging against a second shoulder of the seat.

16. The tool of claim 1, comprising first and second seals disposed on the sleeve, the first and second seals on the sleeve in the closed position sealably engaging in the longitudinal bore respectively upbore and downbore of the bypass port.

17. The tool of claim 16, wherein the sleeve comprises a cross port disposed upbore of the seat and disposed downbore of the second seal, the cross port communicating the internal bore of the sleeve with an annulus between the sleeve and the longitudinal bore.

18. The tool of claim 17, wherein each of the first and second seals on the sleeve in the opened position is sealably disengaged in the longitudinal bore and is exposed on both sides by tubing pressure in the annulus.

19. The tool of claim 18, wherein each of the first and second seals on the sleeve in the closed position sealably engaging in the longitudinal bore is exposed to a pressure differential between the tubing pressure in the annulus and borehole pressure from the bypass port.

20. The tool of claim 17, further comprising a third seal disposed on the sleeve, the third seal on the sleeve when opened and closed sealably engaging in the longitudinal bore downbore of the cross port.

21. A diverter tool for reducing surge pressure when running casing into a wellbore, the tool operable with a plug and comprising:

a housing having a longitudinal bore therethrough, the housing defining a bypass port communicating the longitudinal bore outside of the housing;

a sleeve movably disposed in the longitudinal bore and having an internal bore therethrough, the sleeve being movable in the longitudinal bore from an opened position open relative to the bypass port to a closed position closed relative to the bypass port;

a seat disposed in the internal bore of the sleeve and defining a seat opening permitting fluid communication therethrough, the seat being rotatable in the internal bore from an interposed condition to a stowed condition, the seat in the interposed condition interposed in the internal bore and configured to engage the plug in the seat opening, the seat in the stowed condition exposing the internal bore of the sleeve to the longitudinal bore of the housing;

a first temporary fixture disposed between the housing and the sleeve, the first temporary fixture holding the sleeve in the opened position up to a first limit of applied fluid pressure and releasing the sleeve to move from the opened position to the closed position in response to the first limit acting against the seat in the interposed condition engaged with the plug; and a second temporary fixture disposed between the seat and the sleeve, the second temporary fixture holding the seat in the interposed position up to a second limit of the applied fluid pressure greater than the first limit and releasing the seat to rotate from the interposed condition to the stowed position in response to the second limit acting against the seat in the interposed condition engaged with the plug.

22. A method, comprising:

running casing into a wellbore with a running string having a diverter tool disposed thereon;

diverting surge pressure passing uphole through the running string out of a bypass port in a longitudinal bore of the diverter tool until the casing is run to depth by temporarily holding a sleeve inside the longitudinal bore of the diverter tool opened relative to the bypass port;

engaging a plug in a seat interposed in an interposed condition in an internal bore of the sleeve in the diverter tool, the seat disposed in the internal bore of the sleeve and being movable with the sleeve in the longitudinal bore of the diverter tool;

shifting the sleeve closed relative to the bypass port by applying a first limit of fluid pressure against the plug seated in the seat; and pivoting the seat with the engaged plug from the interposed condition to a stowed condition in the internal bore of the sleeve by applying a second limit of the fluid pressure against the plug seated in the seat.

23. The method of claim 22, further comprising at least one of:

running the plug with the diverter tool when running the casing into the wellbore with the running string having the diverter tool disposed thereon;

launching the plug down the running string to the diverter tool to engage the plug in the seat; and pumping cement down the running string and through the diverter tool to cement the casing in the wellbore.

24. The method of claim 22, wherein shifting the sleeve closed comprises:

shearing the sleeve free to shift in the diverter tool with the first limit of the fluid pressure applied against the plug seated in the seat;

sealing upbore and downbore of the bypass port respectively with first and second seals disposed on the sleeve and sealably engaged inside the diverter tool; and locking the sleeve closed.

25. The method of claim 22, wherein pivoting the seat with the engaged plug from the interposed condition to the stowed condition in the internal bore of the sleeve comprises:

shearing the seat free to pivot in the sleeve with the second limit of the fluid pressure applied against the plug seated in the seat; and locking the seat in the stowed condition.

26. The method of claim 22, further comprising, before running the casing, initially testing seals sealably engaged between the sleeve and the inside of the diverter tool by mechanically shifting the sleeve closed relative to the bypass port.

27. The method of claim 22, further comprising, after shifting the sleeve closed and before pivoting the seat, testing seals on the closed sleeve sealably engaged between the sleeve and the inside of the diverter tool.

* * * * *